US009937404B2

(12) United States Patent
Yahnite

(10) Patent No.: US 9,937,404 B2
(45) Date of Patent: Apr. 10, 2018

(54) GOLF SHOT REFERENCE DEVICE

(71) Applicant: John Yahnite, Riverview, FL (US)

(72) Inventor: John Yahnite, Riverview, FL (US)

( * ) Notice: Subject to any disclaimer, the term of this patent is extended or adjusted under 35 U.S.C. 154(b) by 0 days.

(21) Appl. No.: 15/330,806

(22) Filed: Nov. 7, 2016

(65) Prior Publication Data

US 2017/0128812 A1 May 11, 2017

Related U.S. Application Data

(60) Provisional application No. 62/252,135, filed on Nov. 6, 2015.

(51) Int. Cl.
*A63B 69/36* (2006.01)

(52) U.S. Cl.
CPC ..... *A63B 69/3661* (2013.01)

(58) Field of Classification Search
USPC ..... 473/218, 257, 272, 273, 261–268, 409
See application file for complete search history.

(56) References Cited

U.S. PATENT DOCUMENTS 4,322,084 A 3/1982 Reece et al.
4,384,718 A * 5/1983 Cachola ..... A63B 69/3667 473/218
4,925,192 A * 5/1990 Forbes ..... A63B 69/3667 473/273
5,333,875 A 8/1994 Wilson
5,766,101 A * 6/1998 Chaney ..... A63B 69/3608 473/265
5,827,128 A 10/1998 Finch et al.
D446,276 S * 8/2001 Bankhead ..... D21/791
6,723,003 B1 * 4/2004 Harrell ..... A63B 69/3667 473/266
6,726,576 B1 4/2004 Froggatte
6,913,544 B2 7/2005 Tiffin
D520,096 S * 5/2006 Prestwich ..... D21/791
7,037,210 B2 * 5/2006 Bainter ..... A63B 69/3667 473/270
7,066,827 B2 * 6/2006 Stringer ..... A63B 69/3667 473/270
7,607,987 B2 10/2009 Alter
7,775,900 B1 8/2010 Karpyak et al.
8,435,131 B1 * 5/2013 Carter ..... A63B 69/3641 473/218
8,758,150 B1 6/2014 Parker
2006/0019763 A1 * 1/2006 Anderson ..... A63B 69/3667 473/218

* cited by examiner

*Primary Examiner* — Nini Legesse
(74) *Attorney, Agent, or Firm* — Robert M. Downey, P.A.

(57) ABSTRACT

An elongate substrate strip of durable material with a top side having a linear arrangement of equally spaced circles each representing a regulation size golf ball; the circles being numbered consecutively for use as a reference to indicate ball position and/or foot position. The linear strip may be formed in two segments that are pivotally attached to one another to allow for pivotal swinging movement of one segment relative to the other so that the segments can be extended to a straight linear configuration, a right angle (90 degree) configuration and to a collapsed low profile configuration. The device provides an aid for proper target alignment, body and feet alignment and ball alignment when practicing various golf shots with all types of clubs including woods, short/mid/long irons, wedges and putter. The device also serves as a reference for analyzing divots (i.e., fat, thin, pull, hook) after each practice golf shot.

5 Claims, 6 Drawing Sheets

GOLF SHOT REFERENCE DEVICE

BACKGROUND OF THE INVENTION

This non-provisional patent application is based on provisional patent application Ser. No. 62/252,135 filed Nov. 6, 2015.

Field of the Invention

The present invention relates to a method and a device for use when practicing golf shots and, more particularly, to a golf practice feedback aid device and method of using the device that allows a golfer to analyze divots, as well as to properly align the target, the golfers body, the feet and the ball for each type of golf shot using all types of clubs.

Discussion of the Related Art

As with any sport, improving one's golf game requires regular practice. Golfers usually practice at a range or large open grass field. It is also necessary to practice putting on a practice putting green. When hitting golf shots off of the grass with irons, a divot should be left after each shot. In practice, divots can be extremely useful to a golfer to indicate whether they are hitting the ball properly. For instance, divots can indicate whether the golfer is pulling or slicing the ball, pushing or hooking the ball, hitting the ball thin or hitting the ball fat. However, to properly analyze the divot after each shot, it is necessary to know the ball position relative to the divot. Unfortunately, the divot is created in the process of hitting the ball, and thus once the divot has been formed, the ball is already gone.

In addition to analyzing divots, golfers need to constantly practice proper alignment with the target, as well as proper body alignment and feet alignment relative to the ball. Moreover, proper ball position and spacing of the feet is critical for each type of golf shot. For instance, when hitting with a driver, the feet are positioned further apart and the ball is positioned in alignment with the inside heel of the forwardly positioned foot. As the clubs change from longer range to shorter range, the feet are moved closer together and the ball position is moved progressively rearward from the forward foot towards a position midway between the forward foot and rear foot. Proper stance, body alignment, feet position and alignment, and ball position are critical in order to hit the golf ball properly with each type of club. However, it is not always easy to consistently and precisely reproduce proper spacing of the feet, proper body alignment and stance, as well as proper ball position relative to the feet for each type of club and golf shot.

When practicing golf shots off of the grass at a practice range, the United States Golf Association (U.S.G.A.) recommends placing each shot directly behind the previous divot so that a linear divot pattern is created. In doing so, only a small amount of turf is removed with each swing. This allows for quicker turf recovery, thereby enabling a tee stall to be returned to the same location, minimizing impact at the tee area on the practice range. However, the recommended linear divot pattern can be problematic for some golfers (it is not always easy to maintain a straight back alignment of each shot relative to the previous shot so that the straight divot pattern is created). Moreover, it can be difficult to analyze the divot after each shot due to the long continuous straight pattern. Particularly, it is difficult to determine where the ball placement was before the ball was hit, thereby making it difficult to analyze whether the golfer hit the ball thin (i.e., too close to the ball or topping the ball) or fat (i.e., too far behind the ball).

It can also be difficult for golfers to achieve proper alignment with the target when practicing at a golf range.

Generally, the body should be positioned square to the target so that a straight line across the tips of the toes of the golfer's stance would extend in the direction of the target. Then, when the ball is hit properly, it will travel directly towards the target. Moreover, when practicing putting, it is not always difficult to achieve proper stance, alignment and stroke.

Accordingly, there remains a need for a golf aid for practicing all types of golf shots including driving, long iron, mid iron and short iron shots, wedge shots and putting.

SUMMARY OF THE INVENTION

The present invention is directed to a golf practice reference and feedback device and method of using the device that allows a golfer to analyze divots, as well as to properly align the target, the golfer's body, the golfer's feet and the ball for each type of golf shot using all types of clubs. The device of the present invention includes an elongate substrate strip of material that is relatively thin, durable and lightweight. A top side of the elongate strip is provided with a linear arrangement of equally spaced circles each having a diameter which is approximately equal to a regulation golf ball. The circles are numbered consecutively for use as a reference to indicate ball position and/or foot position. The linear strip may be formed in two segments that are pivotally attached to one another near their ends with the use of a grommet or other fastener that allows for pivotal swinging movement of one segment relative to the other so that the segments can be extended to a straight linear configuration, a right angle (90 degree) configuration and to a collapsed low profile configuration wherein the segments are stacked upon one another. The device provides an aid for proper target alignment, body and feet alignment and ball alignment when practicing various golf shots with all types of clubs including woods, short/mid/long irons, wedges and putter. The device also serves as a reference for analyzing divots (i.e., fat, thin, pull, hook) after each practice golf shot.

BRIEF DESCRIPTION OF THE DRAWINGS

For a fuller understanding of the nature of the present invention, reference should be made to the following description taken in conjunction with the accompanying drawings in which.

DESCRIPTION OF THE PREFERRED EMBODIMENTS OF THE INVENTION

Figure 1:
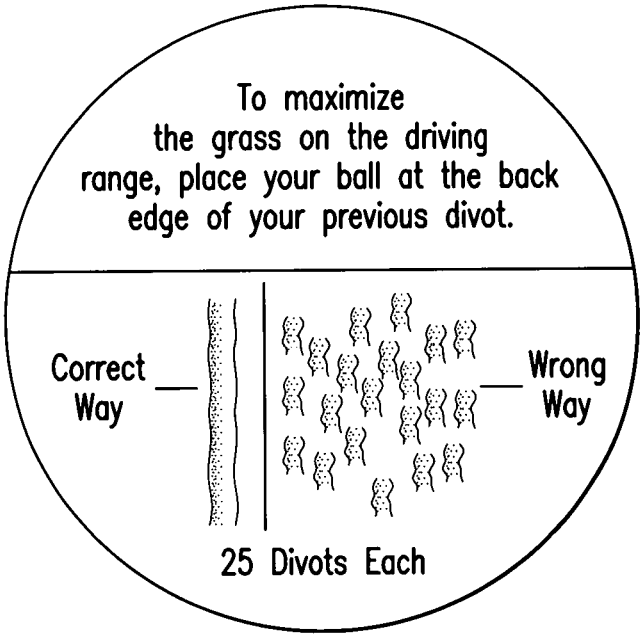
FIG. 1 is a diagram showing a comparison of a recommended linear divot pattern to the undesirable scattered divot pattern, wherein each divot pattern includes 25 divots.
Figure 2:
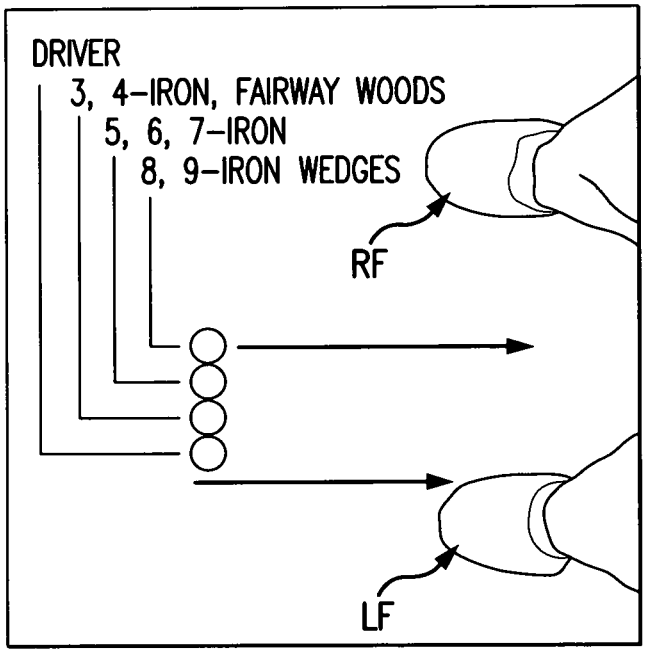
FIG. 2 is a top plan view showing proper ball placement relative to the golfer's feet for the several different types of golf clubs including a driver, long irons, mid irons, short irons and wedges.
Figure 3:
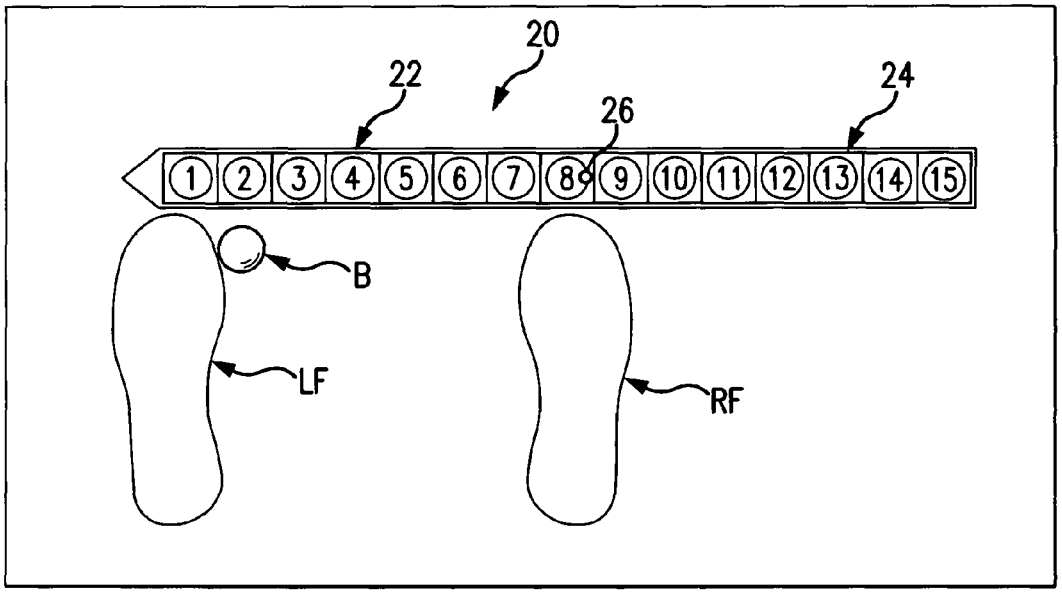
FIGS. 3-5 show a top plan view of the golf practice device of the present invention in relation to a golfer's feet for determining proper foot position and spacing when making shots with a driver and long irons.
Figure 4:
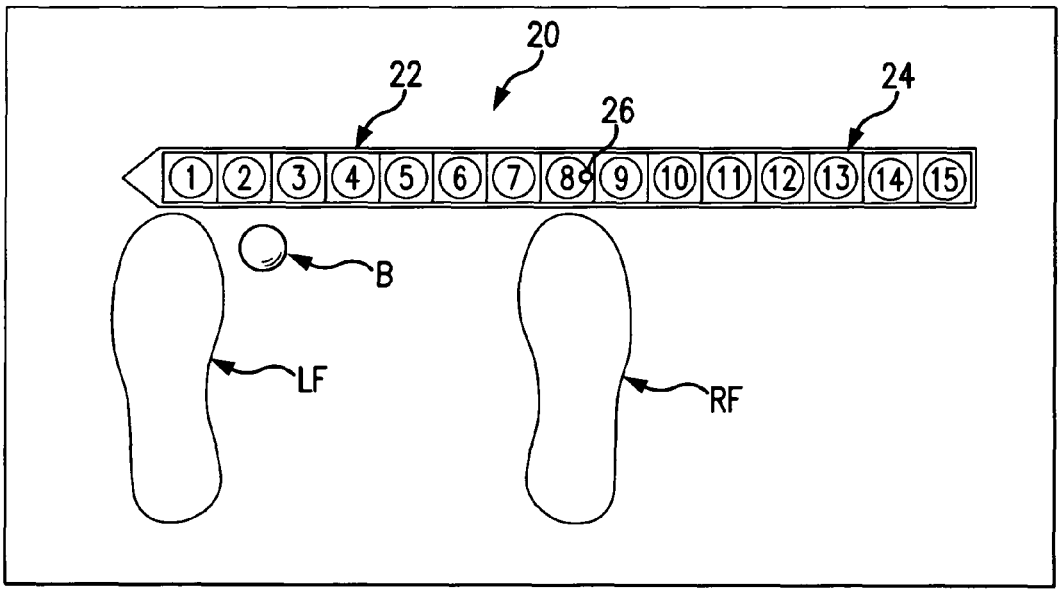
Figure 5:
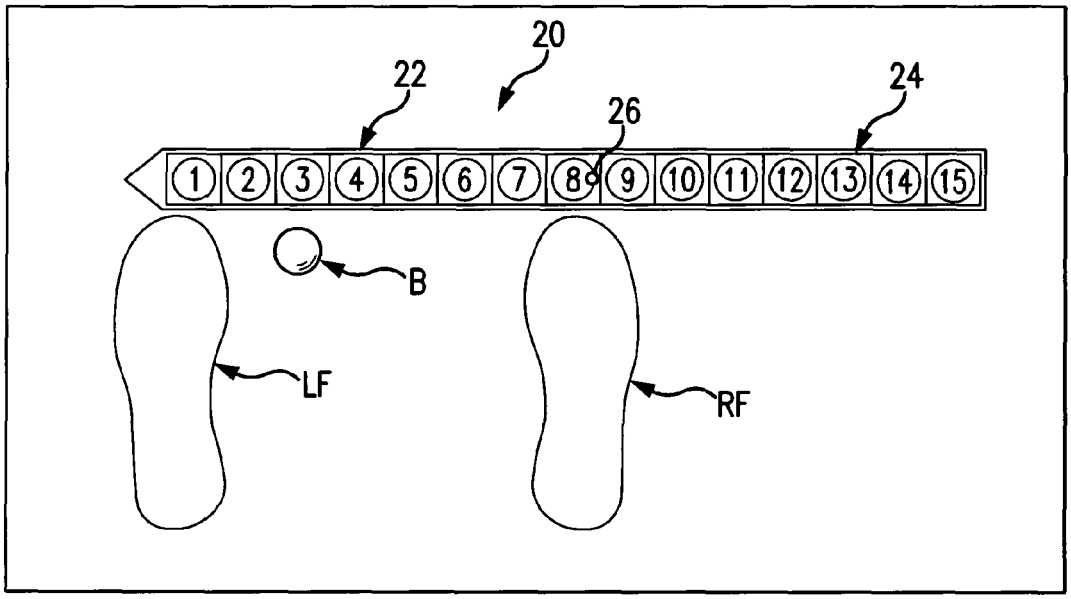
Figure 6:
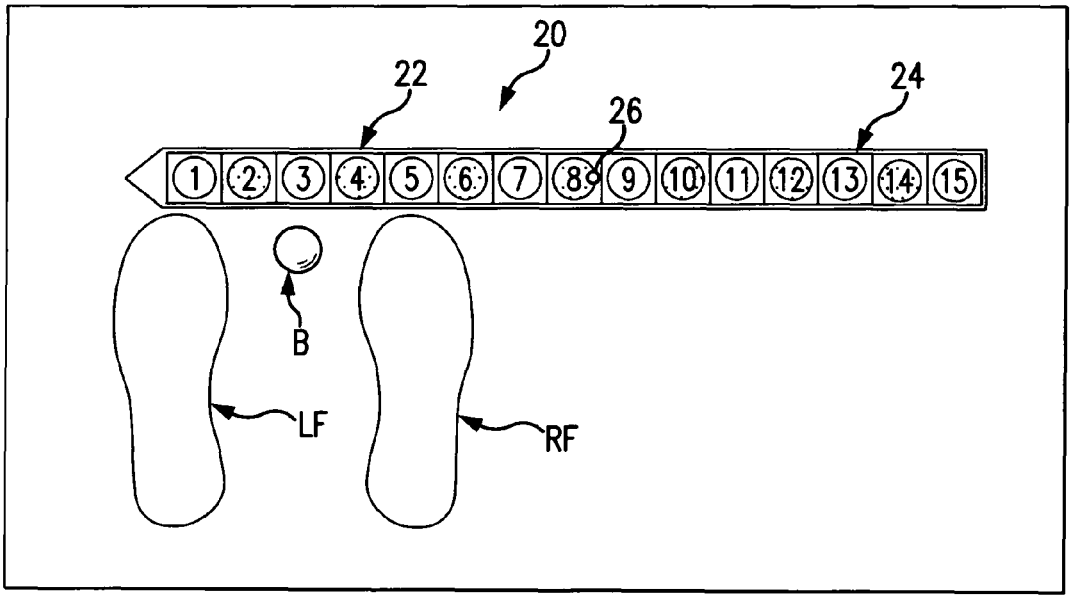
FIGS. 6-8 show a top plan view illustrating the golf practice device of the present invention used for determining proper foot position and spacing between the feet when making wedge shots and short to mid iron shots.
Figure 7:
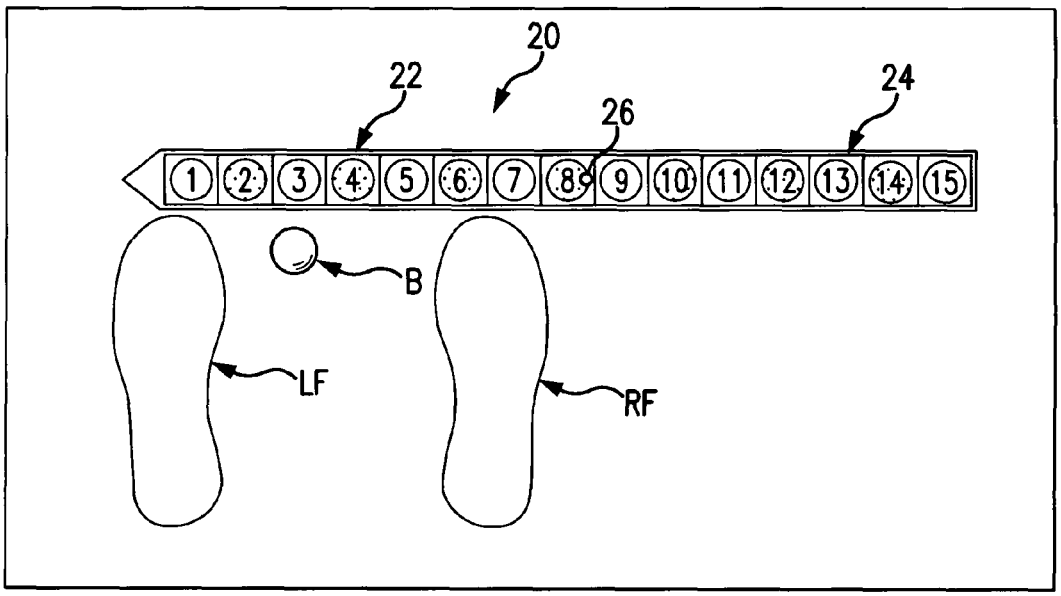
Figure 8:
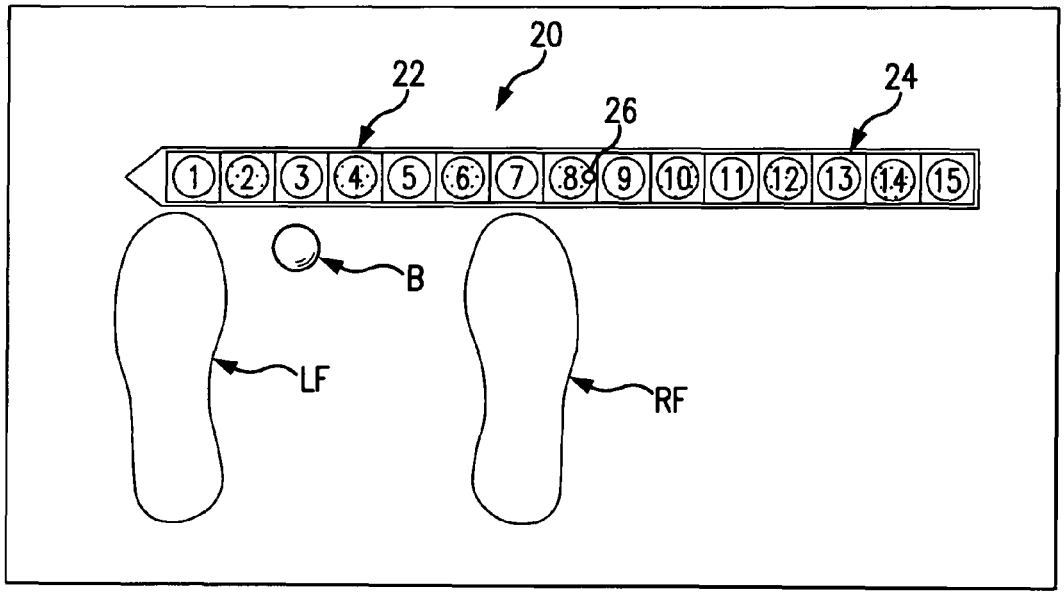
Figure 9:
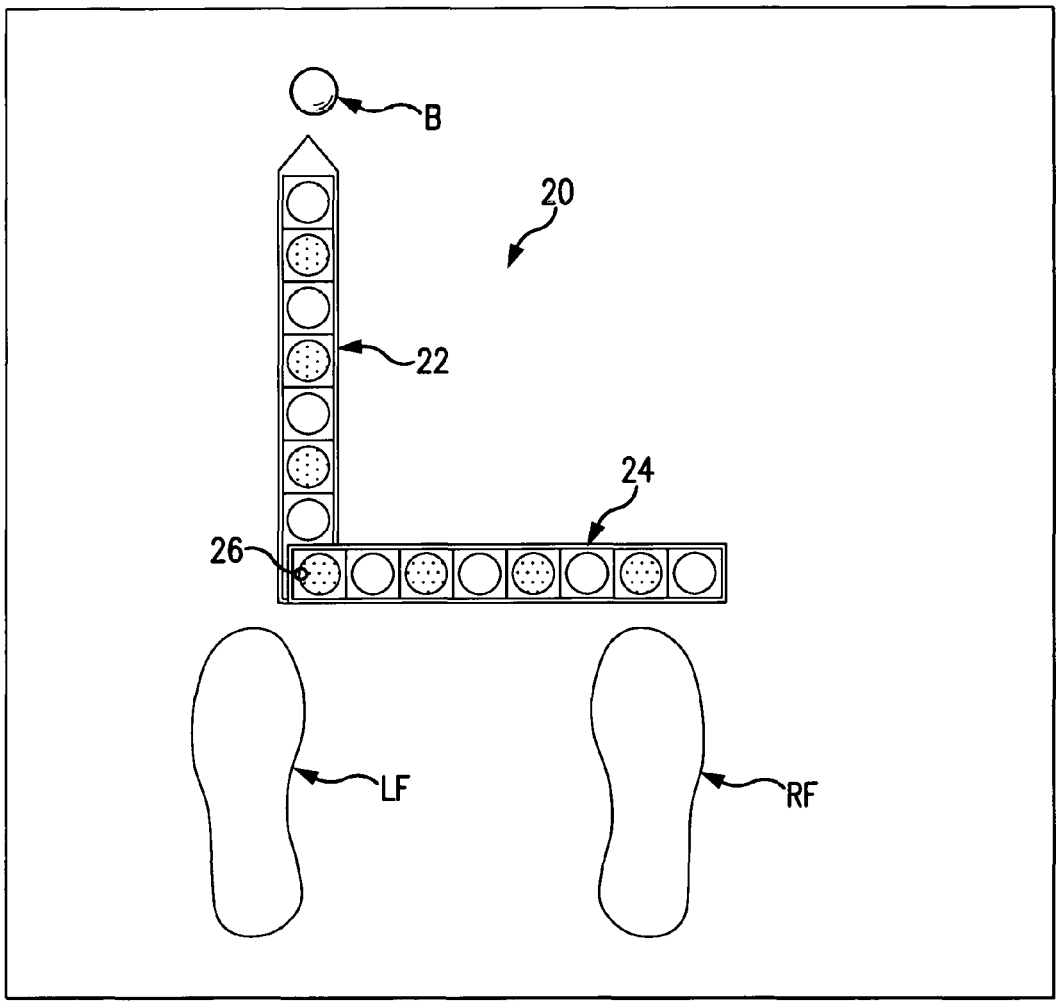
FIG. 9 illustrates use of the golf practice device of the present invention relative to the golfers feet for helping the golfer position the feet and body square to the ball and target with the ball positioned off of the inside heel or hitting with a driver.

Referring to FIGS. 3-11, the golf practice device of the present invention is shown and generally indicated as 20. The golf practice device 20 includes an elongate strip of material that is relatively thin, durable and lightweight. The top side of the elongate strip is provided with a linear arrangement of equally spaced circles that may be separated by transverse or perpendicular lines between each circle. The equally spaced circles have a diameter which is approximately equal to the diameter of a regulation golf ball. In a preferred embodiment, the circles are numbered consecutively (e.g., 1 through 15) for use as a reference to indicate both ball position and proper position and spacing of the feet. The circles may also alternate in colors for ease of reference. For example, the odd numbered circles may be white, while the even numbered circles may be green. Alternatively, all of the circles may have different colors. This contrast in color makes it easier to visualize the spacing and avoid confusion. The linear strip forming the golf practice device of the present invention may be formed in two segments 22 and 24 that are pivotally attached to one another so that the two segments 22 and 24 can be collapsed and stacked, one onto the other, or positioned at a right angle, as seen in FIG. 9. The pivot may be formed with the use of a grommet 26 or other fastener which is located at the center of the elongate strip when fully extended. When not in use, the two segments 22 and 24 can be collapsed in a stacked arrangement for storage in a golf bag or other location.

When using the golf practice device 20 of the present invention for hitting irons on the grass, the device 20 can be useful to analyze the divots while still maintaining the proper linear divot pattern. Specifically, according to a method of the present invention, the device 20 is laid out on the grass and extended in the direction of the target. The ball B should be placed on the grass in alignment with position number 1 on the golf practice device 20. After hitting the ball B, a divot is left in the turf. The golfer can then analyze the divot by comparing the location of the ball B based on reference to position 1 on the device 20. This can be helpful to determine whether the golfer hit the ball thin (to close to the ball) or fat (too far behind the ball). The golfer can then move the ball B back, either a half of a position or a full position, (i.e., to position number 2) in order to make the next shot while continuing to form the desired linear divot pattern.

According to the method of the present invention, the device 20 is further useful to assist the golfer in aligning square with the ball B and in proper alignment with the target. This is achieved by extending the device 20 in the direction of the target with the user's toes positioned along the edge of the device; as seen in FIGS. 3-8. While the ball B is shown positioned between the user's feet and the device 20 in several figures of the drawings for purposes of visually explaining the proper ball position relative to the circles on the device, the ball B being hit would naturally be positioned on the opposite side of the device at the appropriate distance from the user's feet LF and RF for the extended club length. The numbered sequence of circles on the device is also helpful for positioning the feet at the proper distance for each type of club. For example, in FIG. 3, the user's feet can be positioned with the left foot LF aligned with circle number 1 on the device 20 and the right foot RF positioned with circle number 8 on the device 20. After hitting the golf shot, the user can analyze whether they hit the ball B straight, hooked the ball or sliced the ball. The golfer can then take appropriate action to move their right foot RF (i.e., rear foot) further away to position 9 or 10, or a half position therebetween, or closer to the forward foot to position 7 or 6, or a half position between the numbered sequence.

As seen in FIG. 9, the device 20 can be used to achieve proper ball alignment with the feet, as well as the proper distance of the ball from the feet by configuring the two segments 22 and 24 of the device 20 in an L-shape or right angle.

Figure 10:
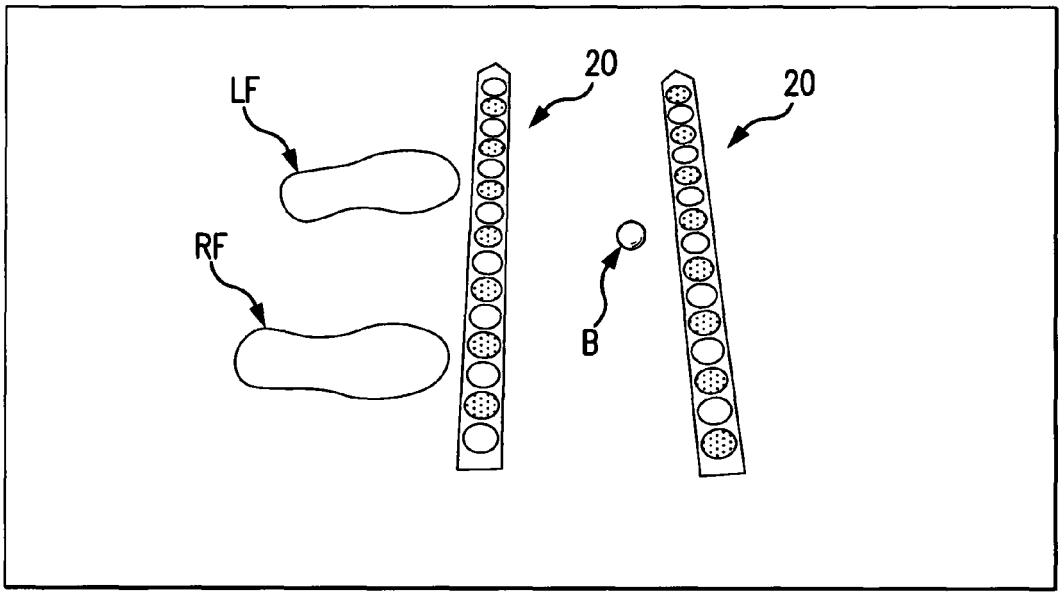
FIG. 10 illustrates use of the golf practice device for assisting with proper target alignment, wherein two of the golf practice devices are positioned in parallel relation to one another, with the ball positioned therebetween, and wherein the devices can be used for proper foot position, foot spacing and ball alignment, as well as proper target alignment.

The golf practice device 20 of the present invention is further useful to achieve proper target alignment. According to the method of the present invention, this can be done by replacing two of the golf practice devices 20 in parallel relation, as seen in FIG. 10. In this case, both of the elongate strips of the two golf practice devices 20 are extended towards the direction of the target so that the golfer can better visualize the proper target direction when addressing the ball B and hitting the ball.

Figure 11:
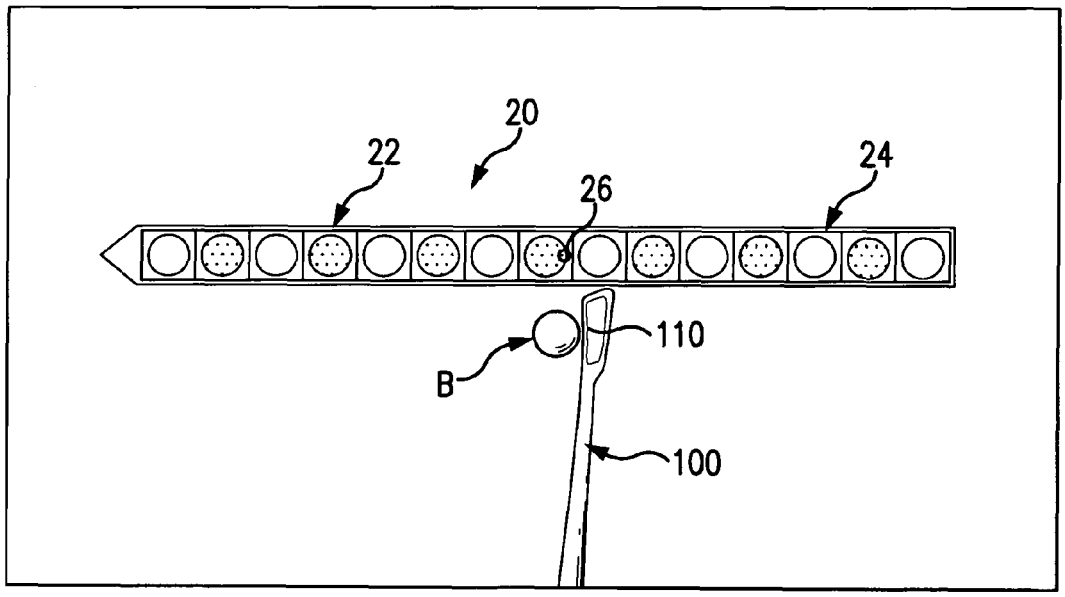
FIG. 11 illustrates use of the golf practice device to assist the golfer in positioning the club face square to the ball prior to making a golf shot.

As seen in FIG. 11, the device is also useful to allow a golfer to properly align the club face 110 of the golf club 100 with the ball B so that the club face 110 is square with the ball B at the point of impact. The lines between the circles on the device are helpful as a reference for aligning the club face 110 square with the ball B.

The golf practice device 20 of the present invention is also useful when practicing putting. Specifically, the golf practice device 20 can be used for achieving proper stance, spacing between the feet and alignment with the hole. Moreover, the consecutively numbered circles on the device 20 are useful for reference in determining the proper stroke length when putting, particularly for long distance putts.

While the present invention has been shown and described in accordance with several preferred and practical embodiments, it is recognized that departures from the instant disclosure are fully contemplated within the spirit and scope of the present invention.

What is claimed is:

1. A method for practicing a variety of different golf shots using different clubs, said method comprising the steps of:

providing at least one elongate strip of a substrate material having a top side, a bottom side, a first end, an opposite second end, opposite side elongate edges extending between the first and second ends, and a total length measured between the first and second ends, and a top side including a linear arrangement of a plurality of equally spaced circles;

placing the at least one elongate strip on a ground surface so that the first end is pointing towards a desired target at which a user desires to hit a golf ball using a particular selected golf club;

placing the golf ball on the ground surface in spaced relation to one of the side edges of the elongate strip and in corresponding alignment with a referenced ball position indicated by at least one of the plurality of equally spaced circles on the top side of the elongate strip;

positioning the user's feet on the ground surface with the user's toes pointing towards one of the side edges of the elongate strip and with a first foot in alignment with one or more of the plurality of equally spaced circles on the top side of the elongate strip and at a distance forward of the referenced ball position and with a second foot in alignment with one or more other ones of the plurality of equally spaced circles on the top side of the elongate strip at a desired distance behind the referenced ball position and at a desired distance of separation from the user's first foot in accordance with a particular golf club length and type being used to hit the golf ball; and hitting the golf ball with the selected golf club and then comparing a position of a divot created in the ground surface to the corresponding referenced ball position on the top side of the elongate strip and further comparing a location where the golf club head first struck the ground surface in relation to where the golf ball was positioned on the ground surface prior to hitting the golf shot as indicated by the referenced ball position on the top side of the elongate strip.

2. The method as recited in claim 1 wherein said elongate strip includes a first strip segment extending from said first end to a proximal end, and a second strip segment extending from said second end to a proximal end, and the first and second strip segments being pivotally attached at the proximal ends to allow pivotal rotating movement of the first and second strip segments relative to one another, and the method further comprising the steps of:

selectively positioning the first and second strip segments either in a straight linear arrangement relative to one another or at a right angle relative to one another;

placing the selectively positioned first and second strip segments on the ground surface; and positioning the golf ball and the user's feet relative to the first and second strip segments for practicing correct body alignment with the golf ball and the target, and correct ball position relative to the user's feet.

3. The method as recited in claim 1 further comprising the step of:

providing a linear arrangement of a plurality of square boxes on the top side of the elongate strip with individual ones of the plurality of equally spaced circles centered within corresponding ones of the linear arrangement of the plurality of boxes, and each one of the plurality of boxes having a line between two correspondingly adjacently positioned circles of the plurality of equally spaced circles, and the line being perpendicular to the opposite side elongate edges of the elongate strip.

4. The method as recited in claim 3 further comprising the step of:

aligning a club face of the user's golf club with one of the lines of the linear arrangement of the plurality of square boxes, wherein the one of the lines is directly behind the referenced ball position to thereby enable the user to properly align the golf club face square with the ball at the point of impact.

5. The method as recited in claim 1 further comprising the steps of:

providing two of the elongate strips of the substrate material;

placing the two elongate strips on the ground surface in spaced, parallel relation to one another with the first end of each of the two elongate strips pointing toward the target; and placing the golf ball on the ground surface between the two elongate strips to allow the user to properly align the user's body and feet relative to the golf ball and the target and to properly visualize the direction of the target when addressing the golf ball prior to hitting the golf ball.

* * * * *